US011176805B2

(12) United States Patent
McNutt et al.

(10) Patent No.: US 11,176,805 B2
(45) **Date of Patent: *Nov. 16, 2021**

(54) APPARATUS, SYSTEM AND METHODS FOR PROVIDING SECURITY CRISIS LOCATIONS AND NOTIFICATIONS

(71) Applicant: BluePoint Alert Solutions, LLC, Elgin, IL (US)

(72) Inventors: John McNutt, Elgin, IL (US); Ken Volkening, Hampshire, IL (US); John Shales, Elgin, IL (US); Todd Stirn, Aurora, IL (US)

(73) Assignee: BLUEPOINT ALERT SOLUTIONS, LLC, Elgin, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/780,189

(22) Filed: Feb. 3, 2020

(65) Prior Publication Data

US 2020/0250962 A1 Aug. 6, 2020

Related U.S. Application Data

(63) Continuation of application No. 16/163,996, filed on Oct. 18, 2018, now Pat. No. 10,553,103, which is a (Continued)

(51) Int. Cl.

| | |
|---|---|
| ***G08B 25/00*** | (2006.01) |
| ***G08B 25/12*** | (2006.01) |
| ***G08B 21/02*** | (2006.01) |
| ***G08B 3/10*** | (2006.01) |
| ***G08B 5/36*** | (2006.01) |

(Continued)

(52) U.S. Cl.

CPC ..... *G08B 25/12* (2013.01); *G08B 3/10* (2013.01); *G08B 5/36* (2013.01); *G08B 7/06* (2013.01); *G08B 21/02* (2013.01); *G08B 25/08* (2013.01)

(58) Field of Classification Search

CPC ..... G08B 25/12; G08B 5/36; G08B 7/06
USPC ..... 340/287, 288, 506, 507, 521, 539.12, 340/539.32, 540, 541, 528, 630
See application file for complete search history.

(56) References Cited

U.S. PATENT DOCUMENTS 5,650,770 A 7/1997 Schlager
5,979,607 A * 11/1999 Allen ..... B66B 5/024 187/390

(Continued)

*Primary Examiner* — Tai T Nguyen
(74) *Attorney, Agent, or Firm* — Patzik, Frank & Samotny Ltd.

(57) ABSTRACT

The present invention provides a system and methods for notifying first responders of the general or specific location of a security crisis or threat in a building or public location, and the type of threat or crisis that has occurred, while notifying building occupants or others in the public location of the crisis and how to respond. The crisis notification system alarm system can provide critical information to the first responders, including location of crisis and whether the crisis location is changing, audio and video of the crisis arena, communications with designated occupants in the crisis arena, and other information. The crisis notification system can be scaled to allow the effective use in facilities of differing sizes and layouts. The system is also flexible, enabling the system to integrate with currently existing systems or to operate with new devices.

25 Claims, 7 Drawing Sheets

Related U.S. Application Data continuation of application No. 15/365,322, filed on Nov. 30, 2016, now abandoned, which is a continuation of application No. 14/864,377, filed on Sep. 24, 2015, now Pat. No. 9,514,633, which is a continuation-in-part of application No. 14/331,875, filed on Jul. 15, 2014, now Pat. No. 9,251,695.

(60) Provisional application No. 61/846,359, filed on Jul. 15, 2013.

(51) Int. Cl.
*G08B 7/06* (2006.01)
*G08B 25/08* (2006.01)

(56) References Cited

U.S. PATENT DOCUMENTS

| | | | | |
|---|---|---|---|---|
| 6,052,052 | A | 4/2000 | Delmonaco | |
| 6,175,308 | B1 | 1/2001 | Tailman | |
| 6,400,265 | B1 | 6/2002 | Saylor | |
| 6,459,371 | B1 | 10/2002 | Pike | |
| 6,462,654 | B1 | 10/2002 | Sandelman et al. | |
| 6,658,091 | B1 | 12/2003 | Naidoo et al. | |
| 6,897,774 | B2 | 5/2005 | Costa et al. | |
| 6,958,689 | B2 | 10/2005 | Anderson et al. | |
| 7,113,090 | B1 | 9/2006 | Saylor | |
| 7,113,099 | B2 | 9/2006 | Tyroler et al. | |
| 7,323,979 | B2 | 1/2008 | Eskildsen | |
| 7,518,500 | B2 | 4/2009 | Aninye | |
| 8,310,365 | B2 | 11/2012 | Siegler et al. | |
| 8,314,680 | B2 | 11/2012 | Ichihara | |
| 8,412,147 | B2 | 4/2013 | Hunter | |
| 8,489,113 | B2 | 7/2013 | Walter | |
| 8,797,210 | B2 | 8/2014 | Derrick | |
| 8,935,052 | B2 | 1/2015 | Hermann | |
| 2004/0056765 | A1 | 3/2004 | Anderson et al. | |
| 2004/0066282 | A1* | 4/2004 | Costa | G08B 13/19626 340/287 |
| 2004/0222884 | A1 | 11/2004 | Costa et al. | |
| 2005/0264413 | A1 | 12/2005 | Eskildsen | |
| 2009/0224966 | A1 | 9/2009 | Boling | |
| 2009/0322853 | A1 | 12/2009 | Katz | |
| 2012/0157037 | A1 | 6/2012 | Hoffman | |
| 2014/0266678 | A1 | 9/2014 | Shapiro | |
| 2015/0204109 | A1 | 7/2015 | Ergenbright | |
| 2016/0232744 | A1* | 8/2016 | Sjoberg | G07F 17/3211 |
| 2018/0364654 | A1 | 12/2018 | Locke | |
| 2019/0130723 | A1 | 5/2019 | Thiel | |

* cited by examiner

APPARATUS, SYSTEM AND METHODS FOR PROVIDING SECURITY CRISIS LOCATIONS AND NOTIFICATIONS

PRIORITY STATEMENT

The present application is a continuation of U.S. patent application Ser. No. 16/163,996, filed Oct. 18, 2018, now U.S. patent Ser. No. 10/553,103, issued Feb. 4, 2020, which is a continuation of U.S. patent application Ser. No. 15/365,322, filed Nov. 30, 2016, now abandoned, which is a continuation of U.S. patent application Ser. No. 14/864,377, filed Sep. 24, 2015, now U.S. Pat. No. 9,514,633, which is a continuation-in-part of U.S. patent application Ser. No. 14/331,875, filed Jul. 15, 2014, now U.S. Pat. No. 9,251,695, which claims the benefit of U.S. Provisional Application No. 61/846,359, filed Jul. 15, 2013. These applications are hereby incorporated by reference in their entireties.

FIELD OF THE INVENTION

The instant disclosure relates to a building or public location notification system and devices for providing the location of a security crisis to first responders and notification to building or location occupants in the event of a security crisis, including security, fire or medical emergency, among others. More specifically, the instant disclosure relates to location determining devices and a notification system and methods, for providing fast and reliable information, such as the location of the crisis in a building or public space, relating to a security, fire and/or medical crisis, to first responders, while also notifying building occupants and individuals within the vicinity and others of the crisis.

BACKGROUND OF TUE INVENTION

There are a number of events that can occur in public and private buildings that rise to the level of a crisis for which first responders, such as fire fighters, police officers and medical personnel, must be called on for assistance. These events can include fire, armed intruders, burglary, acts of terrorism, and injuries from one or more of these events or other events. Many times, the damage and harm from these events can be minimized or eliminated if individuals near the location of the crisis, first responders and others are notified quickly, provided related information and allowed to respond in accordance with their abilities and in accordance with the type of event. For example, individuals near the crisis may be allowed to exit the arena, a school for example, to avoid harm, while first responders may be notified of the existence of the crisis earlier and be able to take quick action to minimize the damage.

An example of a notification system is a building fire alarm notification system, which is capable of notifying first responders or fire fighters and building occupants of the existence of a fire. These systems are well known and have been employed for many years at public and private locations, such as schools, libraries, hospitals, shopping malls, etc. In general, fire alarm notification systems are utilized in large public or commercial buildings in which a significant number of individuals or occupants may be located at any given time. The typical fire alarm notification system provides for some or all of the following functions: detecting a fire (or providing individuals with the chance to notify others of the existence of a fire), notifying nearby occupants of the presence of a fire, notifying the fire department and other emergency personnel, and in some cases, operating certain fire safety functions, such as closing fire retardant doors, setting off the sprinkler system, etc.

Fire alarm notification systems often incorporate detection measures or devices to detect a fire, such as fire and smoke detectors. Additionally, manual fire alarm pull boxes may be placed at strategic locations around a building so that individuals can use the manual boxes, which may commence the notification process earlier than if the notification process was started using the automated fire and smoke detectors. The fire alarm notification systems are usually wired throughout a building so that whether a manual pull box is engaged, or a smoke detector detects smoke and sets off an alarm, occupants throughout the building are notified, fire safety functions can be initiated and the fire department can be automatically notified, usually through an approved central station dispatch or monitor.

To warn building occupants, for example, a siren or sound loud enough to indicate the presence of a fire hazard can be sounded throughout the building along with instructions to direct emergency evacuation. In this instance, the alarm sounds and building occupants understand that they must leave the building immediately, or move to a particular pre-approved location. Visual indicators of the fire emergency may also be employed in combination with the sound producing fire warning devices. The most common devices employed include horns, bells, sirens, stroboscopic lights, and speakers.

Some private locations, such as homes and businesses incorporate fire alarm notification systems, security alarms and medical emergency notification systems, which likewise, attempt to prevent a security crisis or indicate that a security or medical emergency crisis has occurred, such as burglaries, unauthorized intrusions or other illegal activities. These security systems utilize sensors to determine if an intrusion has occurred and then send a signal that an intrusion has occurred.

However, buildings and public locations that may be tens or hundreds of thousands of square feet in size, and may contain hundreds or thousands of occupants, need a more robust security crisis notification system for notifying occupants or individuals located near the vicinity of the security crisis or medical emergency, especially for acts of terrorism or armed intruders, such as those that have occurred over the years at public schools and other public locations. A first responder notification system used for acts of terrorism would provide individuals near the security crisis an increased ability to quickly notify first responders of the crisis, including the general or specific location of the crisis, while also quickly notifying those near the vicinity of the crisis. Over time, and because of the similarities to existing notification systems, building occupants and others would understand the function of the system and be able to utilize the notification devices as necessary to notify first responders and others of the crisis or crises.

Further, since the response of individuals in the area is different for a fire crisis, a police emergency, and for a medical emergency, a system is needed that can address one or more of the different issues that arise during these crises. As such, there currently exists a need for a first responder crisis notification system, which may include particular devices, along with methods that minimizes the time from the inception of the crisis or crises until providing notification to the first responders and others. Such a crisis notification system will allow for faster reaction time and the reduction or elimination of damage and harm to those in the vicinity of the crisis or crises. Quick notification and the transmission of information, including the general or specific location of the crisis, to the first responders and emergency authorities, along with notification and instructions to those in the vicinity of the crisis is vital for reducing injury and death during a security crisis event.

SUMMARY OF THE INVENTION

One aspect of the present disclosure is the devices, system and methods for providing notification to building occupants or other individuals near a crisis, for example, a security, fire or medical crisis, while also notifying first responders or those that provide emergency services, of certain information about the crisis, including the general or specific location and/or if the crisis is moving to a different part of the crisis arena. Along with notification to the first responders, important information can also be provided, based on the system devices, that can assist in the identification of the location in a building or facility, where the crisis or multiple crises have occurred, or to where a crisis has moved, in real time. A point-identifiable crisis or crises alarm, which can inform first responders, such as police officers or SWAT officers where the one or more crises started, can also provide additional information, such as video and audio from cameras and microphones in the arena, to assist in responding to the security crisis or threat.

The crisis notification system is scalable, and the scalability of the notification system or crises alarm system allows the system to be used effectively in different size facilities and public spaces regardless of the design or layout. The notification system is also flexible, using manually operated pendants or manually operated fixed pull down devices or buttons, or a combination of these devices, enabling the alarm system to be integrated with currently existing systems, such as fire alarm systems, or to be configured to operate separately with new devices, such as alarm pulls and transmitters, as described herein.

In an embodiment, a novel alarm pull is utilized in conjunction with the crisis notification system described herein. The novel alarm pull includes a pull device similar in size and shape to existing pull devices that allow an individual to set off a fire alarm, for example. However, the novel pull device is configured to be either battery operated or connected to building power, with backup battery power. The novel pull device further comprises a reset switch for resetting the device after it has been pulled or actuated, either in a real emergency, a test run or inadvertently. The novel pull device further comprises a tamper switch that provides for protection if someone attempts to tampered with the device. The novel pull device is also configured to be connected to the Internet or a Virtual Private Network (VPN), through a communications protocol, such as Wi-Fi, Bluetooth, ZigBee, or any other communication protocol that can be incorporated with a secure connection. Further, the pull device comprises a backup communications protocol, such as an existing cellular connection or a proprietary connection, in case the main communication protocol is disabled.

In embodiments, video cameras, microphones and other information gathering devices set up or located in the facility can be incorporated into the crisis notification system along with particular building information, such as floor plans, utilities and power layouts, and other information as necessary, to provide real time crisis information before and during the crisis. This information can be provided to the first responders at a central dispatch, at mobile locations, such as squad cars and emergency vehicles and even to individual mobile devices, such as cell phones, laptops and tablets, for example. In another embodiment, individuals in the crisis arena will be allowed to transmit audio and/or video to the first responders, either directly or indirectly using the crisis notification system. The individuals in the crisis arena that can communicate with first responders can be a previously designated group and the communication may be through text, electronic mail or voice, among others. Further, the crisis notification system can be configured to provide follow up instructions to those in the crisis arena and/or to the first responders as they respond to the crisis.

By using existing alarm systems, such as fire alarm notification systems, public address (PA) systems, etc., the present notification system does not need to utilize its own communication backbone or standalone security crisis alarm transmission devices. However, a separate alarm system can be implemented alongside an existing fire alarm system or in a location in which no fire alarm system exists, to create a more robust crisis notification system. As detailed herein, the crisis notification system can utilize point-identifiable security crisis signals indicating a location in the facility where the crisis began or has moved to, can be sent to first responders, along with necessary information for a quicker or immediate response to the security threat. The system can employ innovative notification devices, such as intelligent alarm pulls, stationary buttons, mobile pendants (to be worn by select individuals or groups) and switches that may be integrated with other notification devices and systems as described herein.

In an embodiment, multiple pulls and other actuator devices can be used for different type of crises. For example, instead of a single red fire pull on a wall in a school, there may be three or more pulls, including novel intelligent pulls, for different crises. The pulls can be color coded so that a different pull can be actuated for each different crisis, with a red pull for a fire crisis, a blue pull for a security crisis and a green pull for a medical crisis. Each of these different pulls will set into motion different procedures for alerting the proper local authorities and for providing different notifications to individuals in or near the arena depending on the crisis.

As an example, if the red pull is actuated for a fire, the notification would be to exit the building, using a combination of strobes, sirens and verbal instructions, while the fire department was notified and provided information about the building and where the pull was actuated (and ostensibly where the fire started) and when. However, if a blue pull is actuated, there may be instruction to lock all doors in one area, while instructing those in a different area to exit the building, while the local police and national SWAT teams are notified and provided with information about the crisis. Clearly, different pulls will provide for different notifications and instructions.

Other objects and advantages of the present disclosure will become apparent to one having ordinary skill in the art after reading the specification in light of the drawing figures, however, the spirit and scope of the present disclosure should not be limited to the description of the embodiments contained herein.

BRIEF DESCRIPTION OF THE DRAWINGS

The preferred embodiments of the invention will be described in conjunction with the appended drawings, which illustrate and do not limit the scope of the invention, where like designations denote like elements, and in which.

DETAILED DESCRIPTION OF THE INVENTION

The present invention provides a system and methods for providing notification to first responders or emergency service personnel of a security crisis or potential security crisis. In doing so, point-identifiable security crisis alarm signals, from stationary pulls or buttons, or as wearable pendants, capable of indicating a general or specific location in a building or facility, are provided to the first responders for their immediate response to the security threat. Further, depending on the specifications of the crisis notification system, along with the location of the crisis (or at least where the crisis alarm was first reported), information about the crisis can be transmitted to the first responders. The crisis information may include audio or video of the crisis arena, along with specific information about the building layout and utilities, and/or allow for communications with certain designated occupants in the crisis arena, for example.

As described herein, the scalability of the crisis notification system allows the system to be used effectively in facilities of different sizes and layouts. The system is also flexible, enabling the alarm system to be configured to integrate with existing fire or other alarm systems or to operate independently as a new crisis notification or alarm system.

Although the crisis notification system described herein can be incorporated into existing alarm communication backbones, such as existing fire alarm systems, or standalone security crisis alarm transmission devices, the preferred embodiment is an independent, standalone system, made up of stationary pulls, and buttons, wearable pendants, strobe devices, among other devices as described herein. And, although the notification system can be incorporated into existing fire alarm systems, for example, the signal that is created in the present security crisis notification system is distinct and separate from any fire alarm signal that may propagate on the same communications bus. The system may also employ innovative notification devices for detecting a security crisis, or for taking preventative action during a security crisis, and these devices can be integrated into other notification devices and systems.

Figure 1:
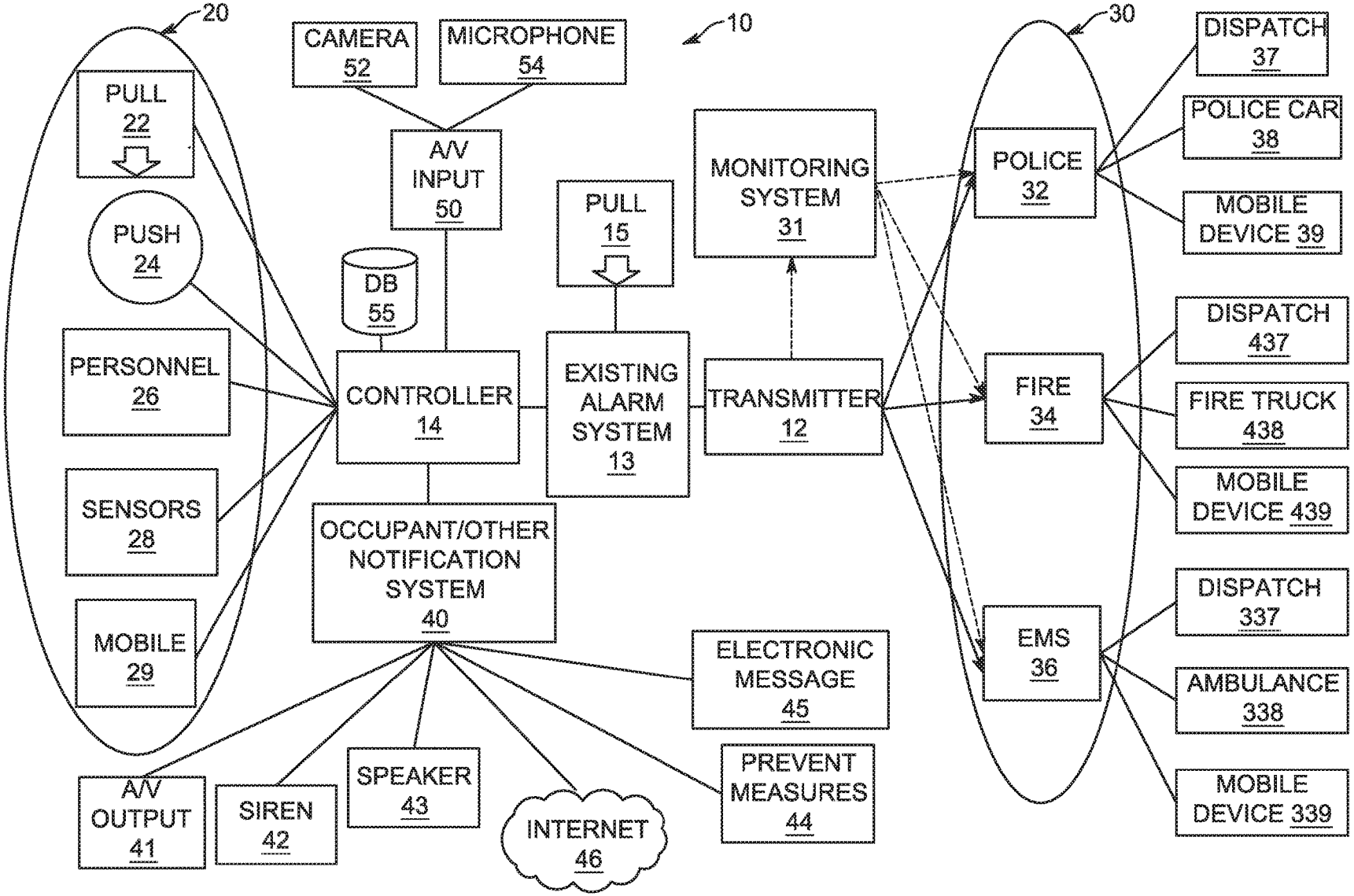
FIG. 1 is a security crisis alarm and notification system in accordance with the present disclosure.

FIG. 1 shows an exemplary notification alarm system or a security crisis alarm system 10. The system 10 comprises a transmitter 12, an optional existing alarm system 13, a controller 14, and a plurality of alarm actuator devices 20 that can be activated to inform first responders and/or individuals in the vicinity and others of a security crisis.

Exemplary embodiments of alarm actuators 20 include pull down actuators 22 (similar to existing fire alarm pulls), push button actuators 24 (both manually actuated), and personnel actuators or pendants 26 that can be worn by an individual and depressed to send a wireless signal to the notification system 10 if a security crisis occurs. These devices are manually actuated and can be located at specific locations throughout a facility based on a variety of factors. Exemplary pulls or pull down actuator 22 placement factors include traffic pattern, building use, occupant age, floor levels, access patterns, egress patterns, and administrative layouts. The pull down actuators 22 can be wired to the system 10 or in the preferred embodiment are wireless transmitters. The system also may include one or more repeaters to ensure that system signals reach all intended locations.

Further, the personnel actuators or pendants 26 and/or mobile actuators 29 may have GPS functionality or features so that a precise location or approximate location can be determined when the personnel actuator 26 is depressed, or even afterwards to locate the personnel actuator 26. The location of the device can also be determined through triangulation as understood by those having ordinary skill in the art.

Additional actuators 20 can include sensors 28, such as door and window detectors for detecting an unwanted breach of a door or window, audible detectors for detecting sounds at certain decibel levels such as gunshots, broken windows, etc., and mobile actuators 29 that can be used in a mobile environment such as a school bus. Once a sound that resembles a gunshot is detected, the location can be determined using different methods, including triangulation methods, etc. As described herein, each of these actuators 20 can be equipped to provide the location of the actuator at the time it is actuated.

In a security crisis event, the controller 14 determines the location of the activation (usually where the security crisis is occurring) and utilizes the transmitter 12 to send a notification (including the location information) of the security crisis either through a monitoring organization or directly and immediately to the first responders 30, such as the police force 32, the fire department 34, or EMS 36. Of course, additional responders can receive the notification, such as FBI or SWAT, etc.

Further, a medical alert system can be added to the crisis alert system, or piggy-backed onto the system, such that, to the extent the area is safe, medical responders can be notified and have a chance to respond as quickly as possible. Once the crisis notification system has been installed, the addition of a medical alert system is simple and straightforward, and may merely include an additional pull down, possibly in another color. For example, if the fire alarm pulls are red, the crisis alert pulls are blue, a medical alert pull may be green.

By notifying the (monitoring organization or) police force 32, the notification can be sent to a central dispatch 37, to specific squad cars 38 or to mobile devices 39, such as mobile phones, laptop computers, and computer tablets. This method provides the quickest form of notification to those first responders that need to respond to the security crisis. Further, as described herein, along with the notification, which notifies the first responder of the security crisis and where it is occurring, additional information, such as audio and video signals of the arena, can be transmitted to the first responders at the squad car 38 or through mobile devices 39. Additionally, secure communications with building occupants, others in the crisis arena or designated personnel can be initiated upon determining that a crisis exists. Further, to the extent that the first responders do not have full-time access to the school or area, a link on a website can be incorporated to allow the first responders to access the school video or audio at that time, or additional information pertaining to the building or public location.

As described above, the controller 14 polls the alarm actuation devices 20, including the manually operated pull downs 22, push button devices 24 and personnel actuators or pendants 26, among others, such that when an alarm actuator device 20 is activated, the controller 14 receives a signal to activate the alarm system 10. The controller 14 can determine the originating alarm actuator device 20 and its location. The controller 14 then activates an occupant notification system 40, possibly through the existing or new PA system, and may also commence building safety measures. Besides notifying building occupants or others in a public location near the security crisis, the occupant notification system 40 may provide notifications to other individuals that have a need to know about the security crisis, such as school administrators, principles of nearby schools, nearby offices and residences and parents of children at the school. The Notification system 10 can be configured to provide different notifications to different recipients depending on the security crisis.

Exemplary embodiments of building occupant and other public location notification devices 40 include an audio/video output 41, sirens 42 such as bells, whistles, stroboscopic lights, and speakers 43, such as those in the existing PA system or others. In the preferred embodiment, all of the devices 40 can be implemented through a wireless system, except the strobes, which may or may not be wired together. Exemplary embodiments also include building safety measures 44 including solenoids that close and lock certain doors or access ways. Additional embodiments include the transmission of electronic messages 45 through email, text, SMS or other predetermined techniques, and transmission of messages to social networks through the Internet 46, among others.

The controller 14 determines the point-identifiable location of the alarm actuator device 20 that was actuated or activated and then formats the point-identifiable signal notification according to the transmitter 12 communication protocol. Along with the location information, the controller 14 may be capable of receiving additional information, such as video and sound, from one or more A/V input devices 50, which receive information at the security crisis location from cameras 52 and/or microphones 54. This additional information can be combined with the signal being sent to the first responders or it can be transmitted separately.

The transmitter 12 receives the point-identifiable signal notification and any additional information from the A/V input devices 50, formatted as necessary by the controller 14 and according to the transmitter 12 communication protocol. The controller 14 may also have a database 55 containing information about the particular building or location, such as floor layout, utilities, power grid, etc. and that information may also be transmitted to the first responders to assist in responding to the security crisis.

Upon receiving the signal, the transmitter 12 immediately sends the point-identifiable signal notification and any additional information as necessary formatted according to the transmitter 12 communication protocol to the first responders 30 or to a monitoring organization or system 31. If the transmitter 12 transmits to the monitoring organization 31, then the monitoring organization 31 transmits the notification and/or information to the first responders 30. The first responders 30 receive the notification and additional information, at the locations and using the devices described above, from the crisis notification system 10 and then can respond to the security crisis with this additional knowledge. Authorized personnel can reset the alarm system 10 after elimination of the security threat.

As described herein, the crisis notification system 10 can be configured to work with an existing building fire alarm system 13 that use similar pull devices 15, or the crisis notification system 10 can be a standalone system as in the preferred embodiment. Also, as described herein, each of the components of the crisis notification system can be wired together, or as in the preferred embodiment, can be a part of a wireless system, using repeaters where necessary.

The plurality of alarm actuator devices 20 can be electrically connected to the controller 14. Electrical connections include all known electrical communication methods including, but not limited to, hardwired (possibly through an existing alarm system) and wireless communication technologies, such as those that use radio frequencies in the 900 MHz, 2.5 or 5 GHz range, Wi-Fi, Bluetooth, ZigBee, etc., all of which are known to one of ordinary skill in the art.

As described above, the pull down actuator 22 is manually actuated by pulling down on a handle, similar to the red fire alarms in many school buildings, while the push button actuator 24 is activated by manually pushing down on the push button. These devices can be located at specific locations throughout a facility based on a variety of factors. Exemplary manual push button actuator 24 placement factors include traffic pattern, building use, occupant age, floor levels, access patterns, egress patterns, and administrative layouts. Often, these manual push buttons 24 will be located in out of the way places, such as under desks or tables, where depressing the button would not be noticed in a crisis event.

The personnel actuator or pendants 26, which are also manually actuated, include a variety of devices carried on or by an individual. An exemplary personnel actuator 26 is an electronic pendant system that is connected to the controller 14 via a wireless connection, as described herein. The personnel actuator 26 can be electrically connected to the controller 14 in any of the known electrical communication methods. In the exemplary system, personnel actuators 26 are placed in the possession of strategic faculty or staff members for manual actuation. Also, the personnel actuators 26, since they are mobile, can be depressed a number of times during the security crisis, which can provide additional information as to the location of the individual wearing the personnel actuator 26, and ostensibly, where the security crisis has moved to.

The building occupant notification system 40, such as the existing or an added PA system, which is used to warn building occupants and others of the security crisis or threat through the use of notification devices 41-45, is flexible and can be integrated with existing mass notification devices. An exemplary mass notification system 40 may send out text or other communication messages 45 to every listed occupant of the building and their emergency contacts upon activation of a security crisis notification system 10. The exemplary system may also broadcast notification through other communication methodologies and mediums such as the Internet 46, or radio or cable. Further, the security crisis notification system 10 provides for designated building occupants or those in or near the security crisis arena to communicate with first responders through the system 10, The communication can be via text, electronic mail, or voice and allows for a direct link from the crisis arena to the first responders.

Figure 2:
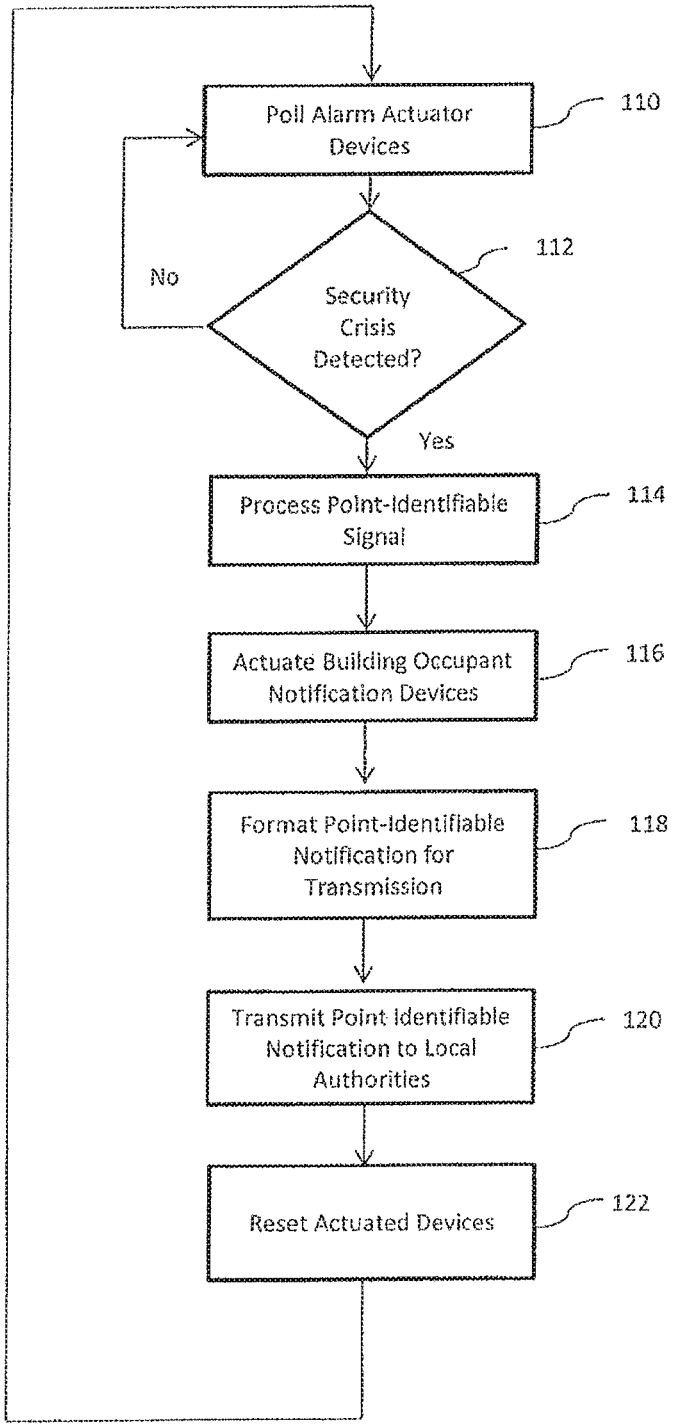
FIG. 2 is a flow chart that illustrates the security crisis alarm activation and notification in accordance with the present disclosure.

FIG. 2 shows an exemplary flow chart detailing the steps that can be performed in accordance with the preferred embodiment of the security crisis notification system 10.

As described in detailed herein, the controller 14 polls the alarm actuation devices 20 at step 110. When an alarm actuator device 20, such as an alarm pull 22, a push button 24, a pendant 26, or a sensor 28, is manually actuated or activated by a sensor, the controller 14 detects a security event or crisis at step 112. The controller 14 processes the point-identifiable notification signal at step 114 to determine the location of the actuator 20 that was activated. The controller 14 then signals the occupant and other notification system 40 to actuate the building occupant notification devices 41-46 at step 116, in accordance with predetermined protocol or as controlled by the system depending on the crisis. The controller 14 then formats or incorporates the point-identifiable information into the occupant notification strategy to provide specific instructions and safety information to building occupants and others depending on the activated actuator device 20 location within the facility at step 118.

In the preferred embodiment, each alarm actuator device 20 of the crisis notification system 10 is point-identifiable, so that the particular device location can be determined along with any other necessary information, upon activation. A monitoring system 31 can be located in between the crisis notification system 10 and the first responders 30, such that when an activation occurs, the monitoring system 31 is first made aware of the crisis and can then relay the notification, the device location, and any other information as needed, to the first responders 30 in accordance with previously determined police or responder protocols.

As described above, the controller 14 may also include additional information from the A/V input devices 50 and from the database 55 pertaining to the building information. The transmitter 12 can then receive the formatted signal and send the formatted point-identifiable notification signal and any additional information to the first responders 30 through a dispatch 37 (if configured as such), to the squad car 38 or to mobile devices 39 or in other ways at step 120. The system 10 may continue to update the additional information as necessary, including audio and visual information pertaining to the crisis. The dispatch or monitor can then dispatch first responders to address the crisis or security threat. The alarm system 10 is reset at step 122.

Battery backups can be incorporated into the point-identifiable actuation devices 20 to ensure that the devices 20 are always powered. The system 10 can supervise or check in with each device 20 to make sure the device 20 is powered and in working order. This supervision process can occur periodically, for example every few minutes, to supervise the system 10 for proper function, low battery, missing pendants, etc. The system 10 can keep track of the supervision function in a database, and accordingly, the system 10 can generate reports on the system devices or the system as a whole.

Figure 3:
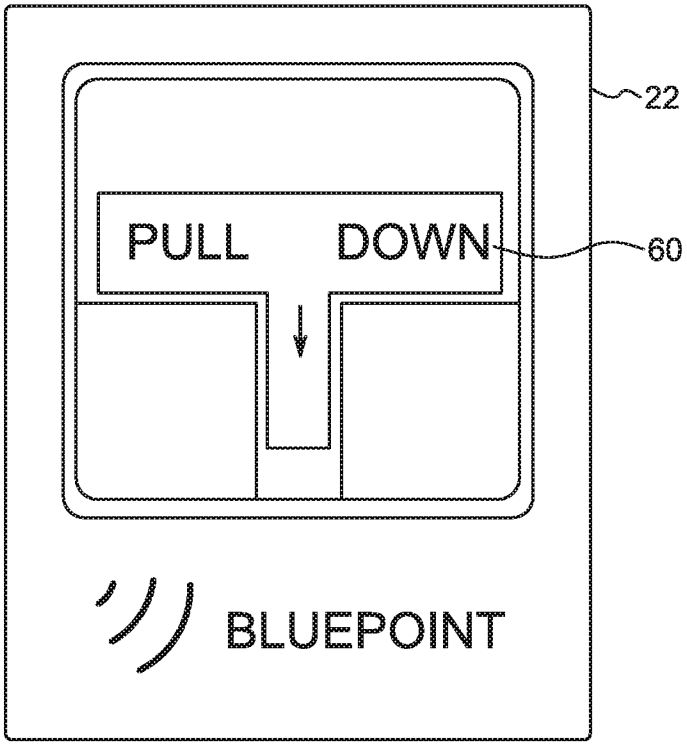
FIG. 3 is a drawing of a pull-down security crisis alarm actuation device in accordance with the present disclosure.

Along those lines, FIG. 3 shows an exemplary manually actuated pull down actuator 22 that can be manually actuated in the event of an emergency. As described herein, the pull down actuator or pull 22 can be color coded to indicate in which type of crisis the pull 22 should be used. For example, a blue pull 22 can be used for security crises, while a red pull could be used for a crisis that involves a fire, and a green pull could be used for medical emergencies. Over time, individuals would understand what each color indicated just as the red pulls are known to most to be used in case of a fire. The pull 22 has a pull handle 60 on the front of the pull 22 which faces outward, so that an individual can pull the handle 60 down, thus actuating it, in the event of a crisis.

Figure 4A:
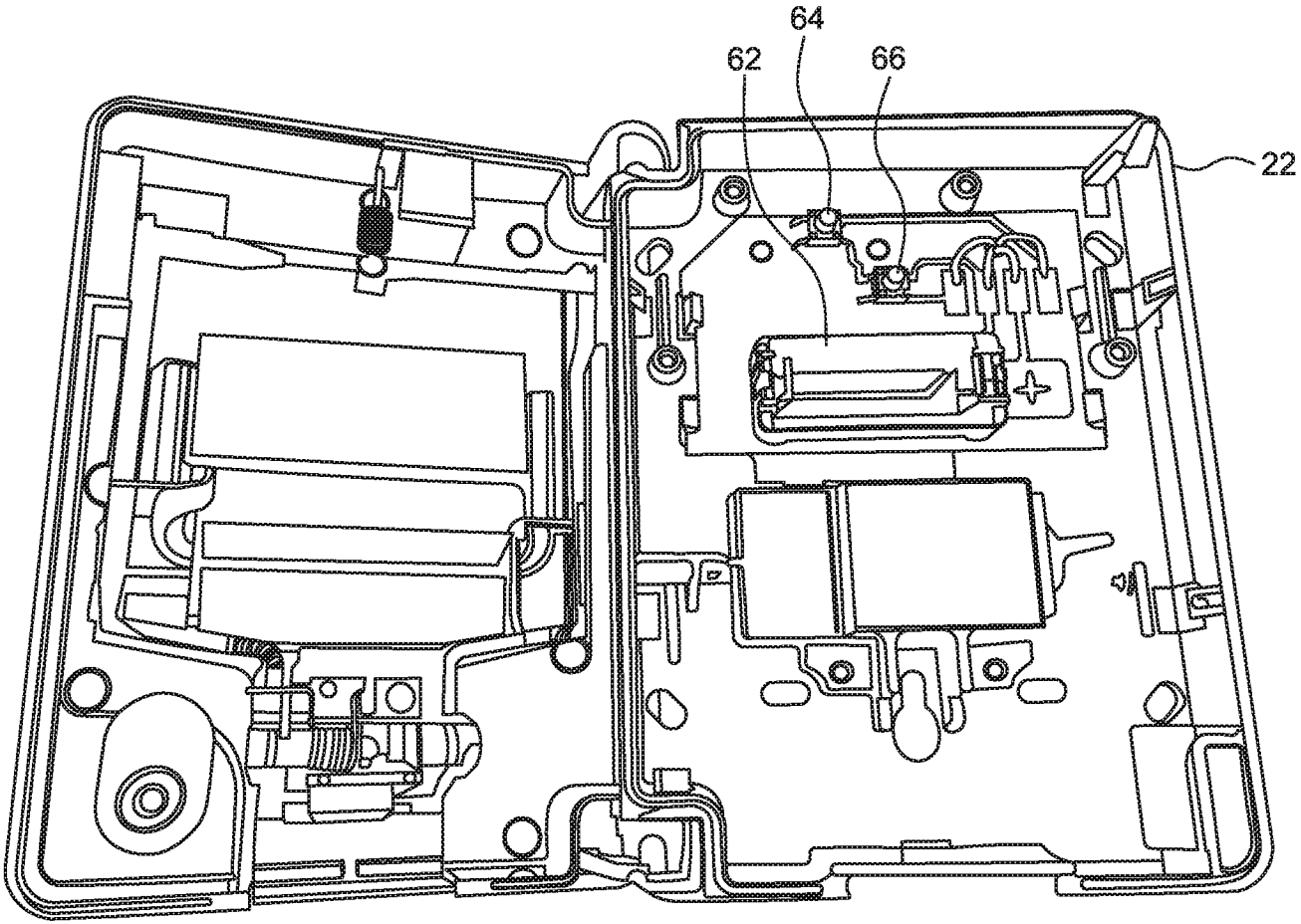
FIG. 4A is a drawing of a pull-down security crisis alarm actuation device in accordance with the present disclosure.

FIG. 4A shows the inside of the pull 22 opened to show the internal components including the backup battery holder 62 (for securely retaining a backup battery), a reset switch 64, and a tamper switch 66. As discussed herein, the pull device 22 can be configured for battery power or connected to building power, with backup battery power using the backup battery holder 62, as shown here. The reset switch 64 is used for resetting the device after it has been pulled or actuated, either in a real emergency, a test run or inadvertently. The tamper switch 66 provides protection if someone attempts to tampered with the device.

Figure 4B:
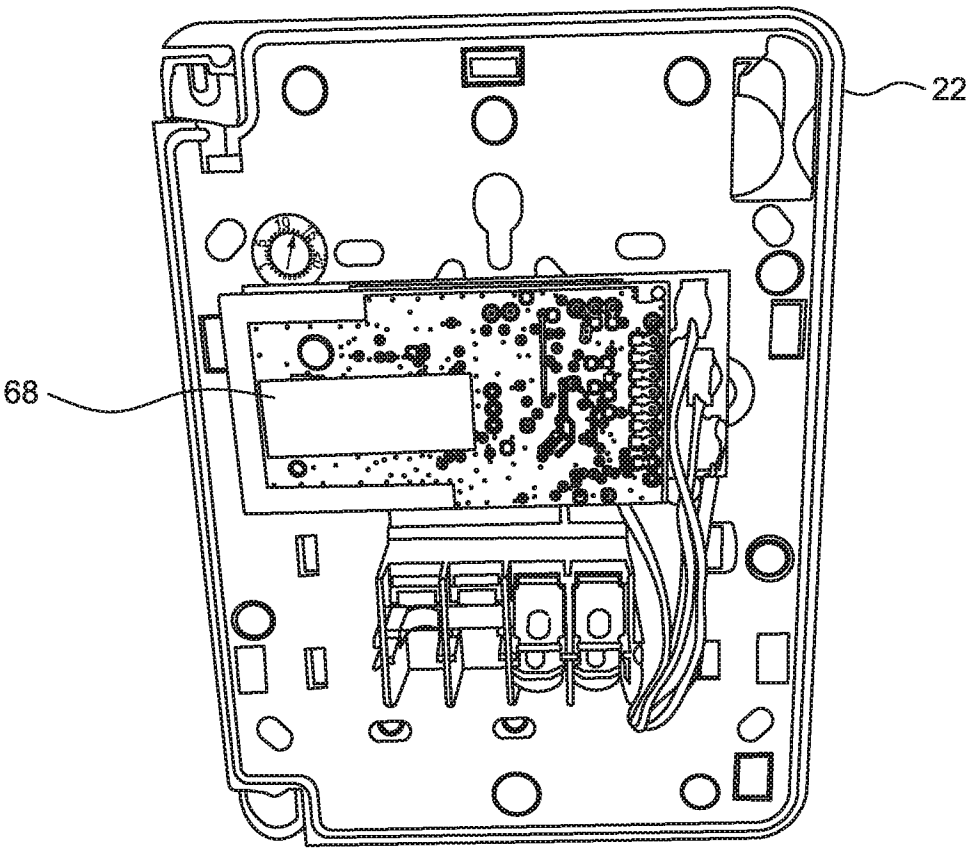
FIG. 4B is a drawing of a pull-down security crisis alarm actuation device in accordance with the present disclosure.

FIG. 4B shows the pull 22 closed from the back side, which is hidden from view when closed (against the wall). The communications board 68 allows for the pull 22 to be connected to the Internet, a VPN, or a cellular network, among others, as described herein. The pull device 22 utilizes the communications board 68 to connect to the Internet, a Virtual Private Network (VPN), or some other communication network through a communication protocol, such as Wi-Fi, Bluetooth, ZigBee, or any other communication protocol that can be incorporated with a secure connection. Further, the pull device 22 may comprise a backup communications protocol, such as an existing cellular connection or a proprietary connection, in case the main communication protocol is disabled.

Figure 5:
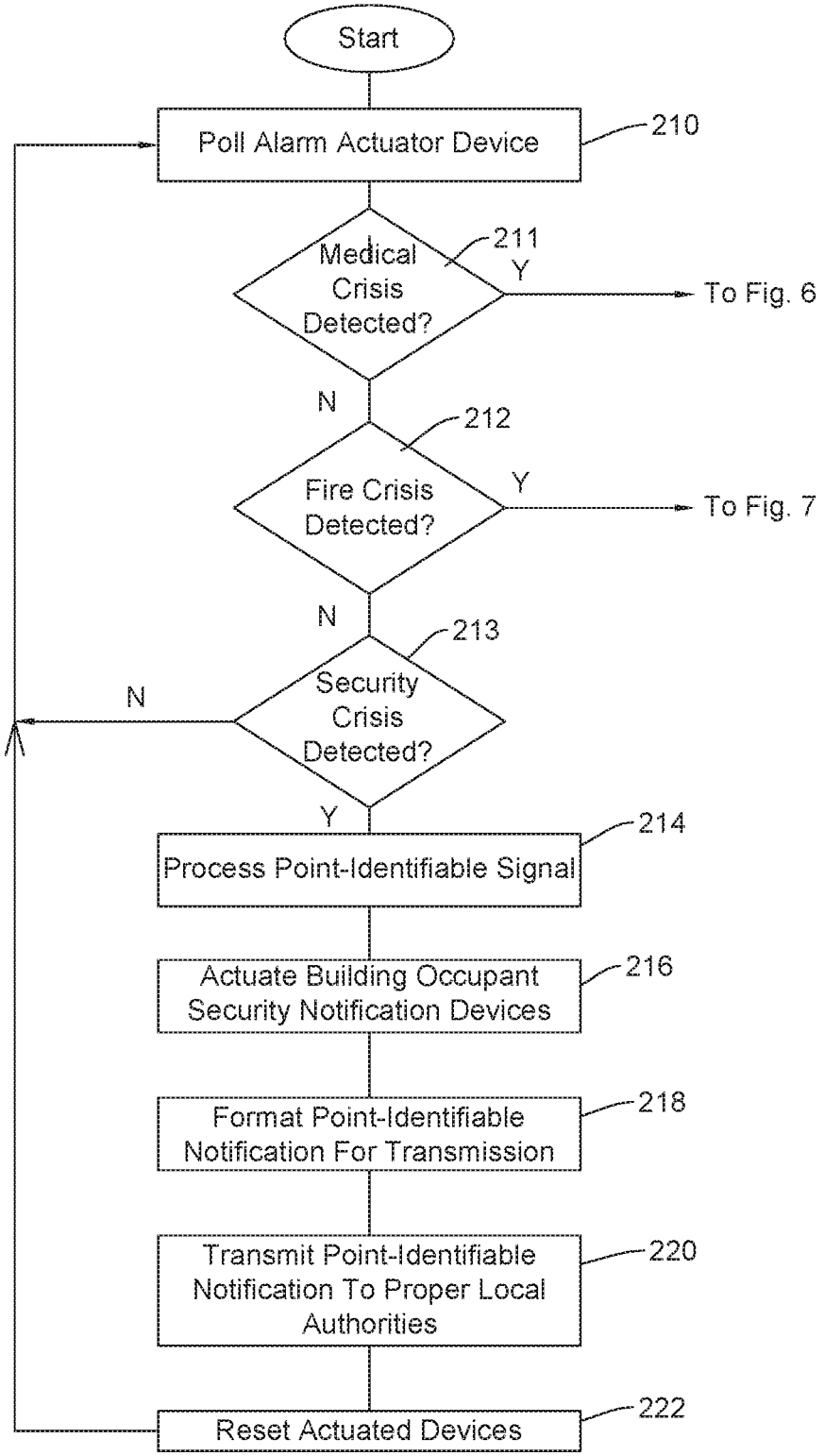
FIG. 5 is a security crisis alarm and notification system in accordance with the present disclosure.
Figure 6:
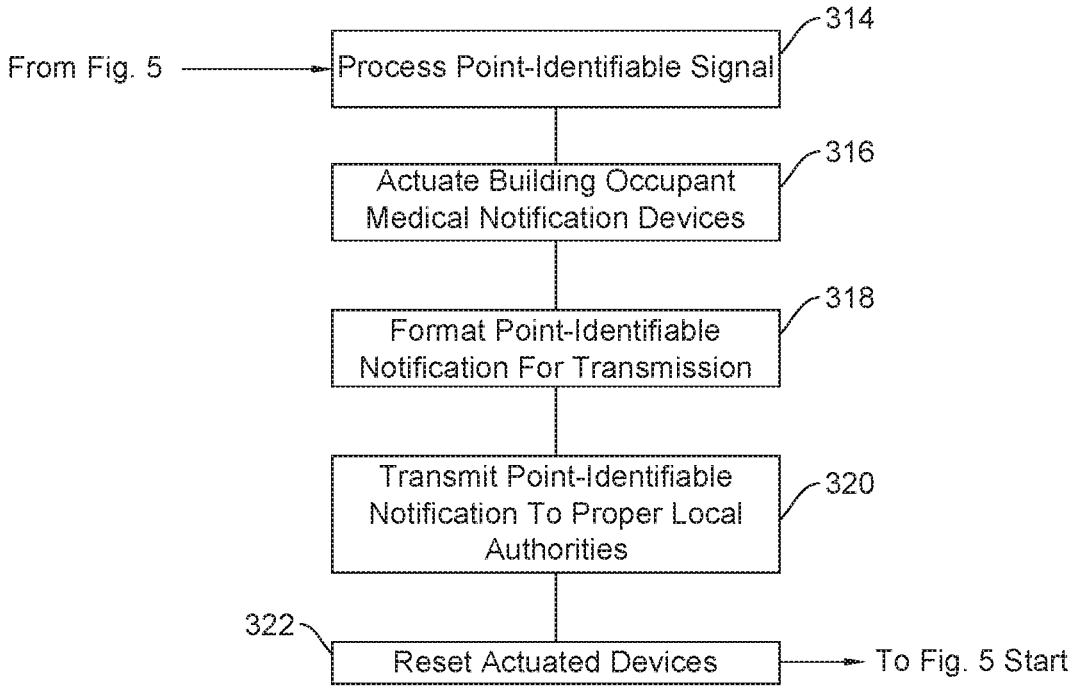
FIG. 6 is a flow chart that illustrates the security crisis alarm activation and notification in accordance with the present disclosure.
Figure 7:
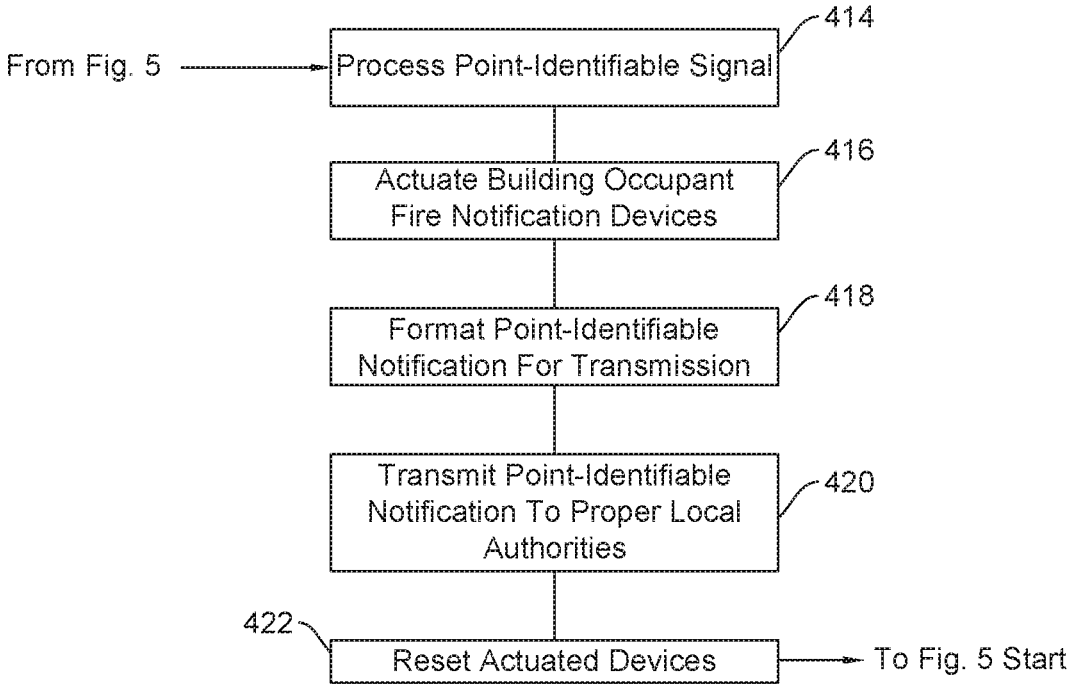
FIG. 7 is a flow chart that illustrates the security crisis alarm activation and notification in accordance with the present disclosure.

FIGS. 5 through 7 are flow charts showing the crisis notification system for multiple crises situations in which the type of crisis must first be determined. In FIG. 5, which is similar to FIG. 2, the alarm actuator devices 20 are polled at step 210 by the controller 14 always checking for the actuation of a device 20. When an alarm actuator device 20, such as an alarm pull 22, a push button 24, a pendant 26, or a sensor 28, is actuated, the controller 14 detects a crisis event, but needs to determine which crisis has occurred. At step 211, the controller 14 determines if the crisis is a medical crisis. If not, the controller determines if the crisis is a fire at step 212, and if not the controller 14 determines if the crisis is a security crisis at step 213. If not, the system returns to again poll the actuator devices 20. However, if the crisis is of a security type crisis, steps are taken similar to those described in FIG. 2. The controller 14 processes the point-identifiable notification signal at step 214 to determine the location of the actuator 20 that was activated. The controller 14 then signals the occupant and other notification system 40 to actuate the building occupant notification devices 41-46 at step 216. The controller 14 then incorporates the point-identifiable information into the occupant notification strategy to provide specific instructions and safety information to building occupants and others depending on the activated actuator device 20 location within the facility at step 218.

As described above, the monitoring system 31 can be located in between the crisis notification system 10 and the first responders 30, such that when an activation occurs, the monitoring system 31 is first made aware of the crisis and can then relay the notification, the device location, and any other information as needed, to the first responders 30 in accordance with previously determined police or responder protocols.

Similarly, the controller 14 may also include additional information from the A/V input devices 50 and from the database 55 pertaining to the building information. The transmitter 12 can then receive the formatted signal and send the formatted point-identifiable notification signal and any additional information to the first responders 30 through a dispatch 37 (if configured as such), to the squad car 38 or to mobile devices 39 or in other ways at step 220. The system 10 may continue to update the additional information as necessary, including audio and visual information pertaining to the crisis. The dispatch or monitor can then dispatch first responders to address the crisis or security threat. The alarm system 10 is reset at step 222.

Returning to step 211, if the controller 14 determines that the crisis is a medical crisis, then the controller 14 processes the point-identifiable notification signal at step 314 in FIG. 6, to determine the location of the actuator 20 that was activated for the medical crisis or emergency. The controller 14 then signals the occupant and other notification system 40 to actuate the building occupant notification devices 41-46 at step 316. In a medical crisis, the notification devices 41-46 may not be incorporated to allow for the crisis to be resolved without individuals being notified. The response depends on the medical emergency situation. Regardless, the controller 14 then incorporates or formats the point-identifiable information into the occupant notification strategy to provide specific instructions and safety information to the building occupants that need to know and others depending on the activated actuator device 20 location within the facility at step 318.

The transmitter 12 can then receive the formatted signal and send the formatted point-identifiable notification signal and any additional information to the first responders 30, which may include EMS or other medical responders 36, through a dispatch 337, if configured as such, to an ambulance 338, to mobile devices 339, or in other ways at step 320. The system 10 may continue to update the additional information as necessary, including audio and visual information pertaining to the medical crisis. The dispatch or monitor can then dispatch first responders to address the crisis or medical emergency. The alarm notification system 10 is reset at step 322, and returns to again poll the actuator devices 20 at step 210 (FIG. 5).

Now returning to step 212, if the controller 14 determines that the crisis is a fire or similar crisis, then the controller 14 processes the point-identifiable notification signal at step 414 in FIG. 7, to determine the location of the actuator 20 that was activated for the fire crisis. The controller 14 then signals the occupant and other notification system 40 to actuate the building occupant notification devices 41-46 at step 416. In a fire emergency, the notification devices 41-46 are usually incorporated to allow for individuals anywhere near the fire an opportunity to exit the arena and are notified as such. In some cases, it makes more sense to remain in the area for safety reasons, and again the response depends on the emergency situation. The controller 14 then incorporates or formats the point-identifiable information into the occupant notification strategy to provide specific instructions and safety information to the building occupants and others depending on the activated actuator device 20 location within the facility at step 418.

The transmitter 12 can then receive the formatted signal and send the formatted point-identifiable notification signal and any additional information to the first responders 30, which may include the fire department, particular fire trucks and other firefighting equipment 34, through a dispatch 437, if configured as such, to an Fire trucks 438, to mobile devices 439, or in other ways at step 420. The system 10 may continue to update the additional information as necessary, including audio and visual information pertaining to the fire. The dispatch or monitor can then dispatch first responders to address the crisis or medical emergency. The alarm notification system 10 is reset at step 422, and returns to again poll the actuator devices 20 at step 210 (FIG. 5).

Although a number of embodiments of this invention have been described above with a certain degree of particularity, those skilled in the art could make numerous alterations to the disclosed embodiments without departing from the spirit or scope of this invention. For example, all joinder references (e.g., attached, coupled, connected, and the like) are to be construed broadly and may include intermediate members between a connection of elements and relative movement between elements. As such, joinder references do not necessarily infer that two elements are directly connected and in fixed relation to each other. It is intended that all matter contained in the above description or shown in the accompanying drawings shall be interpreted as illustrative only and not limiting. Changes in detail or structure may be made without departing from the spirit of the invention as defined in the appended claims.

What is claimed is:

1. A security threat alarm system for notifying building occupants of, and first responders of a location of, a security threat, comprising:

a plurality of alarm actuation devices, said plurality of alarm actuation devices located in a same building, said plurality of alarm actuation devices comprising at least one pull down device, wherein said at least one pull down device is manually actuated upon an existence of a security threat, and upon actuation, said at least one pull down device transmits a location signal indicating a location in the same building of the at least one pull down device that has been actuated;

a controller, said controller coupled to said at least one pull down device, said controller for receiving said location signal from said at least one pull down device upon actuation and for determining the location of the one or more of said at least one pull down device that has been actuated, said controller controlling said at least one notification device to notify said building occupant that one of said at least one pull down device has been actuated;

a transmitter, said transmitter coupled to said controller, said transmitter for transmitting said location signal received from said controller upon actuation of said at least one pull down device to at least one first responders, thereby informing said at least one first responder of the location in the same building of said at least one pull down device that has been actuated.

2. The security threat alarm system of claim 1, wherein said at least one pull down device comprises a pull handle, a backup battery holder, a reset switch, and a tamper switch.

3. The security threat alarm system of claim 2, wherein, said backup battery holder securely retains a backup battery.

4. The security threat alarm system of claim 2, wherein said reset switch resets said at least one pull down device after being actuated.

5. The security threat alarm system of claim 2, wherein said tamper switch provides protection from tampering with said pull down device.

6. The security threat alarm system of claim 1, further comprising at least one notification device, said at least one notification device coupled to said controller and located in the same building, wherein when said at least one pull down device is actuated, said at least one notification device notifies a building occupant that one of said plurality of alarm actuation devices has been actuated.

7. The security threat alarm system of claim 6, wherein said at least one notification device is a speaker.

8. The security threat alarm system of claim 7, wherein said speaker notifies said building occupant through a pre-recorded message.

9. The security threat alarm system of claim 6, wherein said at least one notification device is a siren.

10. The security threat alarm system of claim 6, wherein said at least one notification device is an electronic message.

11. The security threat alarm system of claim 10, wherein said electronic message is one of an electronic mail, a text message or a social media notification.

12. The security threat alarm system of claim 6, wherein said at least one notification device notifies said building occupant through an Internet communication.

13. A method of using a security threat alarm system for notifying a building occupant of, and first responder of the location of, a security threat, comprising in a same building, at least one pull down device, said at least one pull down device providing a location signal upon actuation, a controller, and a transmitter, comprising the steps of:

a) installing at least one pull down device, in a same building;

b) installing said controller, in said same building;

c) monitoring said at least one pull down device to determine if said at least one pull down device has been actuated;

d) upon actuation, receiving a location signal from said at least one pull down device that was actuated, e) determining a location in the same building that said at least one pull down device has been actuated;

f) transmitting a notification of said location to a first responder; and g) notifying a building occupant of said actuation of said at least one pull down device.

14. The method of using a security threat alarm system of claim 13, wherein said at least one pull down device comprises a pull handle, a backup battery holder, a reset switch, and a tamper switch.

15. The method of using a security threat alarm system of claim 14, wherein, said backup battery holder securely retains a backup battery.

16. The method of using a security threat alarm system of claim 14, wherein said reset switch resets said at least one pull down device after being actuated.

17. The method of using a security threat alarm system of claim 14, wherein said tamper switch provides protection from tampering with said at least one pull down device.

18. The method of using a security threat alarm system of claim 13, further comprising at least one notification device, said at least one notification device notifying a building occupant that one of said plurality of alarm actuation devices has been actuated.

19. The method of using a security threat alarm system of claim 18, wherein said at least one notification device is a speaker.

20. The method of using a security threat alarm system of claim 19, wherein said speaker notifies said building occupant through a pre-recorded message.

21. The method of using a security threat alarm system of claim 18, wherein said at least one notification device is a siren.

22. The method of using a security threat alarm system of claim 18, wherein said at least one notification device is an electronic message.

23. The method of using a security threat alarm system of claim 22, wherein said electronic message is one of an electronic mail, a text message or a social media notification.

24. The method of using a security threat alarm system of claim 18, wherein said at least one notification device notifies said building occupant through an Internet communication.

25. The method of using a security threat alarm system of claim 13, further comprising the step of h) providing for communication between said first responder and said building occupant.

* * * * *